United States Patent [19]

Wirges

[11] 4,245,826

[45] Jan. 20, 1981

[54] RESILIENT COLUMN OF ADJUSTABLE LENGTH

[75] Inventor: Winfried Wirges, Koblenz-Moselweiss, Fed. Rep. of Germany

[73] Assignee: Stabilus GmbH, Koblenz-Neuendorf, Fed. Rep. of Germany

[21] Appl. No.: 59,530

[22] Filed: Jul. 23, 1979

Related U.S. Application Data

[63] Continuation of Ser. No. 814,553, Jul. 11, 1977, abandoned.

[30] Foreign Application Priority Data

Jul. 23, 1976 [DE] Fed. Rep. of Germany ... 7623283[U]

[51] Int. Cl.[3] ..... F16F 3/07; F16F 3/08

[52] U.S. Cl. ..... 267/131; 188/300; 188/321; 248/565; 267/121; 267/151; 267/152; 297/345

[58] Field of Search ..... 188/300, 321; 267/131, 267/132, 121, 133, 151, 152, 34, 35, 140.3, 140.4, 141, 141.1; 248/354 H, 565, 415; 297/345, 355

[56] References Cited

U.S. PATENT DOCUMENTS

| | | | |
|---|---|---|---|
| 3,220,688 | 11/1965 | Baermann | 248/415 X |
| 3,711,054 | 1/1973 | Bauer | 297/345 X |
| 3,790,119 | 2/1974 | Bauer | 248/400 |
| 3,801,085 | 4/1974 | Sandor . | |
| 3,891,236 | 6/1975 | Kawano et al. | 267/132 X |

FOREIGN PATENT DOCUMENTS

| | | | |
|---|---|---|---|
| 1976323 | 1/1968 | Fed. Rep. of Germany | 267/131 |
| 6945465 | 11/1969 | Fed. Rep. of Germany . | |
| 6716671 | 6/1968 | Netherlands | 188/321 |
| 906550 | 9/1962 | United Kingdom . | |

*Primary Examiner*—George E. A. Halvosa
*Attorney, Agent, or Firm*—Brumbaugh, Graves, Donohue & Raymond

[57] ABSTRACT

A column which includes an elongated guide tube receiving a pneumatic spring of the piston-and-cylinder type in its bore. A bar is fixedly fastened to the piston rod member or the cylinder member of the spring in longitudinal alignment and extends in the guide tube bore from the associated spring member toward one of the two longitudinally terminal parts of the guide tube. A spring assembly extending about the bar is interposed between spring seats on the pneumatic spring member fixedly fastened to the bar and the one terminal part of the guide tube. Cooperating abutments on the bar and on the one terminal part of the guide tube limit movement of the bar toward the other longitudinally terminal part of the guide tube.

13 Claims, 4 Drawing Figures

RESILIENT COLUMN OF ADJUSTABLE LENGTH

This is a continuation of application Ser. No. 814,553, filed July 11, 1977, now abandoned.

BACKGROUND

1. Field of the Invention

This invention relates to resilient columns of adjustable length, and particularly to improvements in a column of the type disclosed in German Utility Model No. 1,976,323.

2. The Prior Art

The known column, suitable for supporting the seat of a stool on a stool base, includes a normally upright guide tube in which a pneumatic spring of the cylinder-and-piston type is received, a valve permitting communication between the two compartments of the cylinder cavity normally sealed from each other by the piston. A compression spring is arranged between annular spring seats on the guide tube and an element of the pneumatic spring for providing resiliency when the stroke of the pneumatic spring is exhausted. The known column, while effective, is relatively expensive to assemble from elements not available at low cost.

SUMMARY

A primary object of this invention is the provision of a resilient column of adjustable length which can be assembled from cheaper components at lower labor cost than the known column, yet functions at least as well.

With this object and others in view, the invention provides a column of adjustable length in which an elongated guide tube receives at least a part of a pneumatic spring in its longitudinal bore for movement in the direction of tube elongation. The pneumatic spring, conventional in itself, includes a cylinder member defining a sealed cavity therein. A piston is movable in the cavity and normally seals two compartments of the cavity from each other. A piston rod member is fastened to the piston and projects outward of the cylinder cavity in the direction of guide tube elongation. A fluid under a pressure higher than atmospheric pressure fills the cavity. A bar fixedly fastened to one of the two afore-mentioned members of the pneumatic spring extends from the one member toward one of the two longitudinally terminal parts of the guide tube. A yieldably resilient device extends about the bar and is interposed between spring seats on the one member of the pneumatic spring and on the terminal guide tube part for resiliently opposing movement of the spring seats toward each other. Cooperating abutments on the bar and on the one terminal guide tube part limit movement of the bar toward the other longitudinally terminal part of the guide tube.

BRIEF DESCRIPTION OF THE DRAWINGS

Other features, additional objects, and many of the attendant advantages of this invention will readily be appreciated as the same becomes better understood by reference to the following detailed description of preferred embodiments when considered in connection with the appended drawing in which.

DETAILED DESCRIPTION

Figure 1:
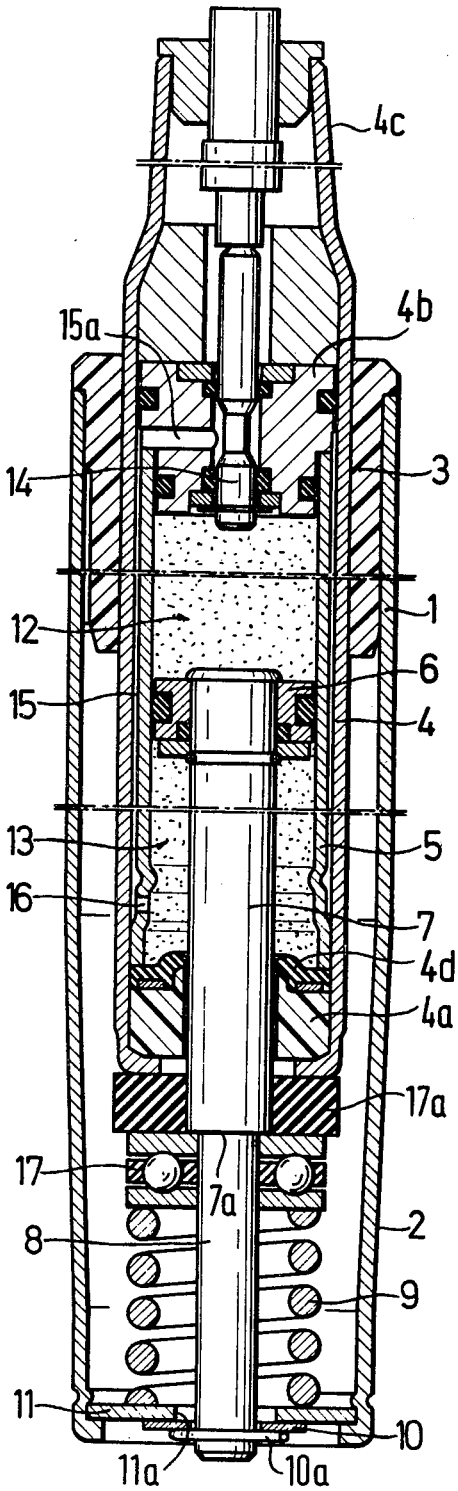
FIG. 1 shows a column of the invention in elevational section.

Referring now to the drawing, and initially to FIG. 1, there is seen a column suitable for resiliently supporting the seat of a stool above the base of the stool at a distance which is capable of stepless adjustment. The normally visible parts of the column consist of an upright, outer guide tube 1 of circular cross section whose longitudinally terminal, lower portion 2 tapers conically, a cylinder 4 projecting coaxially from the top of the guide tube 1 and having a tapering end portion 4*c*, and a plastic sleeve 3 lining the upper orifice of the tube 1 to facilitate axial and angular movement of the cylinder 4 in the tube 1.

The cavity in the cylinder 4 is sealed axially by plugs 4*a*, 4*b* to prevent escape of compressed air or nitrogen which fills the cavity. A coaxial tubular liner 5 in the cylinder cavity is slidably engaged by the circumference of a piston 6 which normally seals two axial compartments 12, 13 of the cavity from each other. The two compartments may be connected by an annular duct 15 between the liner 5 and the inner wall face of the cylinder 4 which permanently communicates with the compartment 13 through radial bores 16 in the liner 5 near the lower plug 4*a* and which may be connected with the compartment 12 through radial bores 15*a* in the upper plug 4*b* and a manually operable valve 14 in a central, axial bore of the plug 4*a*. The operating mechanism for the valve 14 is known in itself and may be of the type shown in FIGS. 2 and 3 and described hereinbelow.

A cylindrical piston rod 7 depends from the piston 6 and passes outward of the cylinder cavity through a central bore of the plug 4*a* which carries an annular lip seal 4*d*. A coaxial cylindrical bar 8 of reduced diameter is integrally fastened to the outer end of the piston rod 7 so that an annular end face 7*a* of the piston rod 7 is available as a spring seat for an axially terminal face of a resilient assembly confined in the bore of the tube 1 and consisting of a helical compression spring 9 and a thrust bearing 17 axially engaging each other. An axially fastened washer 11 provides a radial end wall of the guide tube 1 and another spring seat for an axially terminal face of the compression spring 9. The bar 8 passes through the bearing 17, the spring 9, and the central aperture 11*a* in the washer 11 and carries a smaller washer 10 secured by a spring clip 10*a* on its free end outside the bore of the guide tube 1.

The spacing of the washer 10 from the annular end face 7*a* is smaller than the combined axial dimensions of the washer 11, the spring 9 and the bearing 17 in the relaxed condition of the spring so that the spring is stressed in all axial positions of the piston rod 7 in the guide tube 1, upward movement of the piston rod toward the upper, axially terminal part of the tube 1 being limited by the illustrated abutting engagement of the washers 10, 11, but downward movement of the piston rod 7 being opposed only by the resiliency of the spring 9 until its several turns abuttingly engage each other. An annular rubber bumper 17*a* on the outer bottom face of the cylinder 4 protects the face 7*a* and the bearing 17 against shock damage when the spring 9 is permitted to expand suddenly into the illustrated position.

The spring 9 provides sufficient contact pressure between the spring and the washer 11 to impede relative rotation of the spring and the washer about the column axis, but the bearing 17 permits rotation of the piston rod 7 and of the entire pneumatic spring, such rotation being interfered with very little by the sliding engagement of the washers 10, 11.

The column described above consists of machine elements which are staple articles of commerce or can be prepared from readily available stock materials by simple shaping or machining operations. The conically tapering ends 2, 4c of the guide tube 1 and of the pneumatic spring cylinder 4 may be inserted into mating openings of a stool base and of a stool seat in the usual manner to provide a stool having a resilient support column functioning in a known manner.

The effective length of the column may be changed while the valve 14 is open to permit flow of compressed gas between the compartments 12, 13. A load applied to the cylinder 4 when the cylinder is attached to the seat of a stool causes resilient compression of the gas in the compartment 12 and compression of the spring 9. When the stroke of the piston 6 inward of the compartment 12 is exhausted, the spring 9 still may provide resiliency to the column. The bar 8 moves axially downward through the aperture 11*a* at this stage, but cannot move inward of the bore in the tube 1 after removal of the load from the non-illustrated seat beyond the illustrated position of abutting engagement of the washers 10, 11.

If a compression spring shorter than the illustrated spring 9 is interposed between the spring seats on the washer 11 and the annular face *7a*, the spring may be permitted to relax fully in the absence of a load on the stool seat, and the washers 10, 11 may not be engaged during normal operation of the stool. They still prevent the pneumatic spring from being pulled out of the guide tube 1 when the stool is lifted from the ground by the seat so that the weight of the non-illustrated base tends to move the tube 1 downward. A spring long enough to be stressed under all operating conditions is preferred because of its more nearly linear characteristic.

The piston rod 7 and the bar 8 are unitary portions of a piece of cylindrical bar stock partly turned down on a lathe, but a separate cylindrical bar element 8 may be fastened axially to the piston rod 7 in any desired manner. The bar 8 is rotatably received in the thrust bearing 17 with the minimal clearance necessary for relative axial movement during assembly of the column, but adequate support for the entire spring assembly may be provided with greater clearance or with a thrust bearing which is partly attached to a member of the pneumatic spring. Other variations and permutations of the illustrated column may still be assembled from commercial shapes in a very simple manner. The column illustrated in FIG. 1 is made up from a valved pneumatic spring, itself a staple article of commerce, by machining its piston rod, from washers, springs, bearings and like hardware, and a guide tube 1 and sleeve 3 which are manufactured at very low cost. The spring may be assembled with the bumper 17*a*, bearing 17, and spring 9 before being inserted into the guide tube 1 previously provided with the sleeve 3 and washer 11. The washer 10 and spring clip 10*a* are attached last to complete the assembly.

Figure 2:
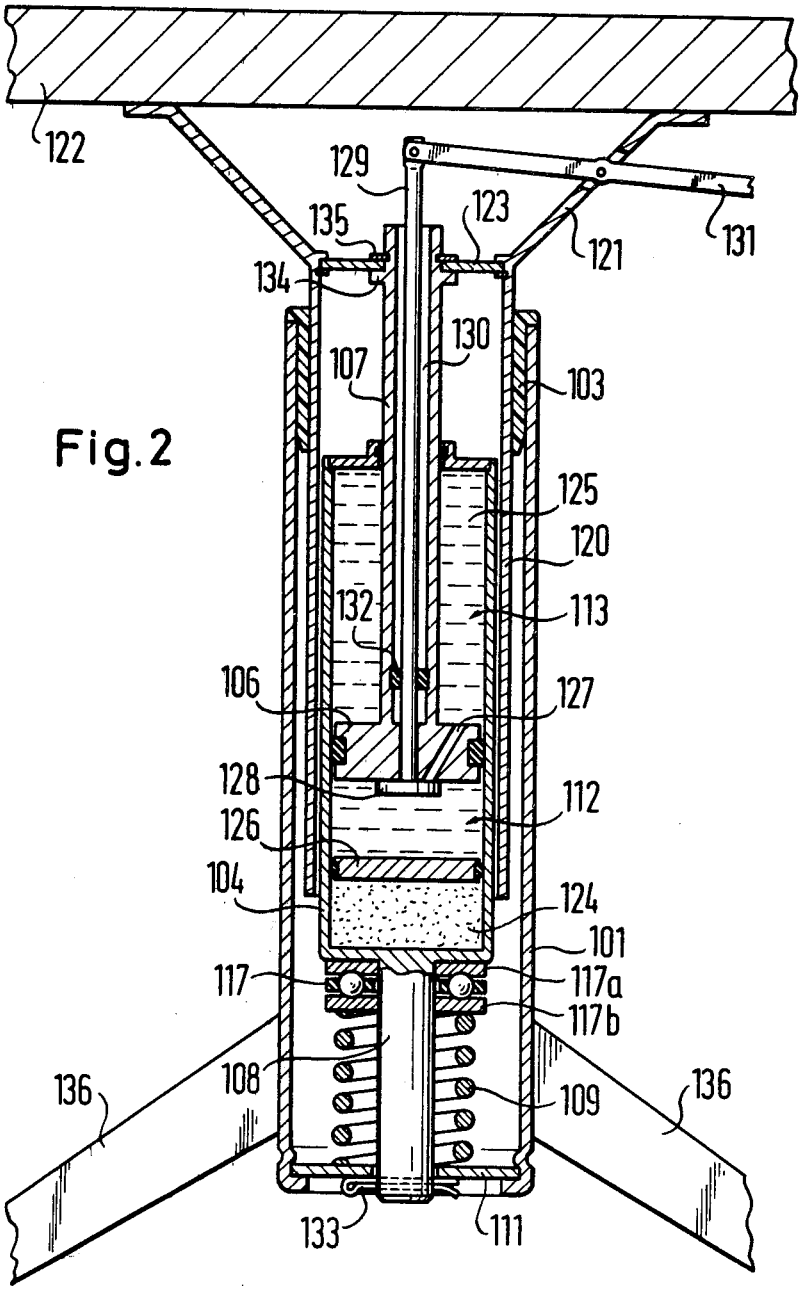
FIGS. 2 and 3 illustrate additional columns of the invention in respective views substantially corresponding to that of FIG. 1; and, FIG. 4 is a fragmentary, elevational section of yet another embodiment of the invention.
Figure 3:
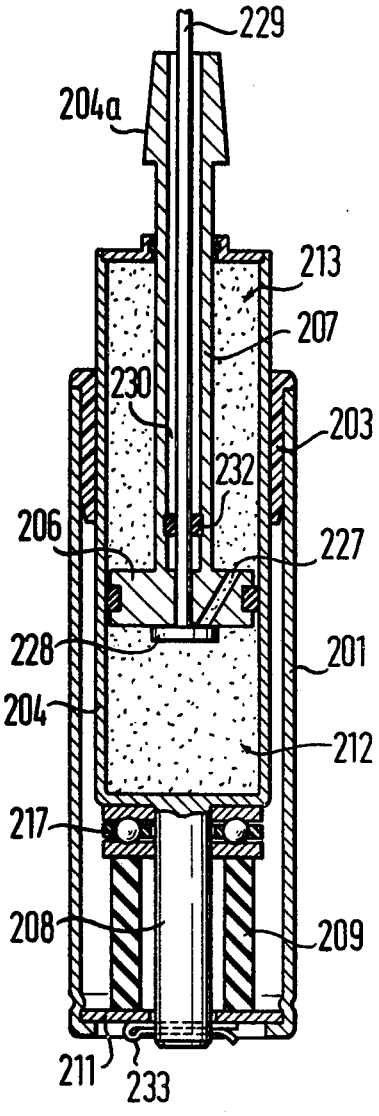
Figure 4:
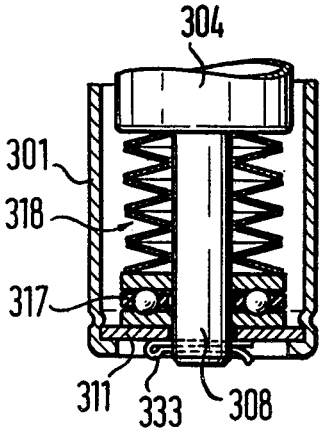

The modifications of this invention which are readily available on the basis of the above teachings are partly illustrated in FIGS. 2 to 4.

FIG. 2 shows a column of the invention which has an outer guide tube 101 from which chair legs 136 extend obliquely downward in angularly spaced relationship relative to the upright axis of the tube 101, only two of the three legs 136 being visible. An inner guide tube 120 is separated from the outer guide tube by a plastic sleeve 103 for relative axial and angular movement and carries the bottom bracket 121 of a chair seat 122. A tubular piston rod 107 passes axially through a central opening in an upper, radial end wall 123 of the inner guide tube 120, and is secured axially by a collar 134 and a retaining ring 135.

The piston rod 107 is slidably sealed into a cylinder 104 and carries a piston 106 in the cylinder cavity which is axially divided by the piston into compartments 112, 113. The compartment 112 is further axially divided by a floating piston or partition 126, the space 124 below the partition containing a gas under high pressure, whereas the cylinder cavity is otherwise filled with a liquid 125, such as hydraulic brake fluid. The two compartments 112, 113 may be connected by a bore 127 in the piston 106 which is normally sealed by a valve disc 128 in the compartment 112. The valve disc is mounted at the lower end of an operating rod 129 movable in the axial bore 130 of the piston rod 107, and sealed to the rod by an elastomeric ring 132 which prevents escape of fluid from the cylinder cavity through the bore 130. The rod 129 may be moved to lift the valve disc 128 from an orifice of the bore 127 by a lever 131 on the bracket 121, but the disc 128 is normally held in the closed position by fluid pressure in the cylinder cavity.

A cylindrical bar 108 of much smaller diameter depends from the bottom wall of the cylinder 104 which also carries the upper collar 117*a* of an annular thrust bearing 117 coaxially receiving the bar 108. A helical compression spring 109 is interposed between a spring seat on the lower collar 117*b* of the bearing 117 and another spring seat on the bottom wall 111 of the guide tube 101. The bar 108 freely passes through an aperture in the bottom wall and is secured against undesired upward movement by a cotter pin 133.

The column shown in FIG. 2 operates in the same, basically known manner described with reference to FIG. 1, and is equally capable of easy assembly from readily available components because the pneumatic spring and all associated elements may be inserted as a sub-assembly into the guide tube 101 through the upper axial orifice of the tube, and are axially secured against withdrawal by the cotter pin 133 alone which thereafter is normally held in abutting engagement with the bottom wall 111 by the spring 109.

Yet another column of the invention is shown in FIG. 3. It has a single, outer guide tube 201 equipped with a plastic, anti-friction sleeve 203 in which the cylinder 204 of a valved pneumatic spring is movably received. A piston rod 207 projects axially from the cylinder 204 and carries a mounting cone 204*a* for connection to a seat assembly. A piston 206 is axially secured to the inner end of the piston rod 207 in the cylinder cavity divided by the piston into compartments 212, 213. The axial length of the pneumatic spring is controlled in the manner described above by a valve disc 228 normally closing a bore 227 in the piston 206, but capable of being lifted by an operating rod 229 movably sealed in a bore 230 of the piston rod 207 by a resilient ring 232.

The cylinder 204 rests on a resilient support which includes an annular thrust bearing 217. The top collar of the bearing is attached to the cylinder bottom while the lower collar provides a spring seat for a coaxial tube 209 of reinforced, elastomeric material, preferably oil-resistant, synthetic rubber. The radial bottom wall 211 of the outer guide tube 201 provides another spring seat for the rubber tube 209. A bar 208, fixedly and coaxially attached to the lower, radial end wall of the cylinder 204 passes with ample clearance through the bearing 217, the rubber tube 209 and a central aperture in the end wall 111. Its free end outside the bore of the tube 201 carries a cotter pin 233 in the manner described with reference to FIG. 2.

It is preferred to provide a compression spring axially interposed between the pneumatic spring and the bottom wall of the guide tube in a column of the invention with a thrust bearing to facilitate the swivel movement of an associated stool seat on the stool base, but such a bearing may be omitted if easy swivel movement should not be needed. The specific location of the bearing and the nature of the compression spring may be varied as is illustrated in FIG. 4 which shows a modification of the otherwise unchanged column illustrated in FIG. 3.

The lower, radial end wall of the pneumatic spring cylinder 304 carries a bar 308 of reduced diameter which passes out of the bore of the guide tube 301 through a central opening in the bottom wall 311 of the guide tube and is secured by a cotter pin 333 as described above. Resilient support for the pneumatic spring is provided by a stack of belleville washers 318 enveloping the bar 308 between a spring seat on the cylinder 304 and another spring seat on the upper collar or bearing ring of an annular thrust bearing 317 whose lower collar or ring is fastened on the bottom wall 311. Such fastening is unnecessary if the opening in the thrust bearing matches the outer diameter of the bar 308 with little clearance.

It should be understood, of course, that the foregoing disclosure relates only to preferred emobidments of the invention, and that it is intended to cover all changes and modifications of the examples of the invention herein chosen for the purpose of the disclosure which do not constitute departures from the spirit and scope of the invention set forth in the appended claims.

What is claimed is:

1. A column of adjustable length comprising:

(a) an elongated guide tube having a longitudinal axis and formed with a longitudinal bore,
  (1) said tube having an apertured end wall transverse to said axis,
  (2) said end wall having an axially inner face and an axially outer face directed in axially opposite directions;

(b) a pneumatic spring at least partly received in said bore for axial movement therein and including
  (1) a cylinder member defining a sealed cavity therein,
  (2) a piston axially movable in said cavity and normally sealing two compartments of said cavity from each other,
  (3) a piston rod member fastened to said piston and projecting axially outward of said cavity, and
  (4) fluid in said cavity under a pressure higher than atmospheric pressure for elastically supporting said piston rod member within said cylinder member so as to resist a load transmitted to the end of the pneumatic spring remote from said apertured end wall;

(c) a bar member axially elongated and fixedly fastened to one of said members of the pneumatic spring, said bar member axially extending from said one member through said bore and through the aperture in said end wall for movement inward and outward of said bore;

(d) spring seat means on said one member in said bore;

(e) yieldably resilient means located entirely within said bore between said spring seat means and the axially inner face of said end wall for biasing said bar member inward of said bore in the direction of said remote end and for resiliently permitting substantial axial displacement of said bar member outward of said bore in response to a load applied to the remote end of said pneumatic spring, thereby to afford additional resilience in the column in series with the resilience afforded by the pneumatic spring; said resilient means surrounding said bar member and being axially prestressed between said seat means and said inner face in all positions of said one member within said bore; and (f) an abutment member carried by said bar member outside said bore and dimensioned for abutting engagement with said outer face of said end wall to limit movement of said bar member inward of said bore, said abutment member being urged into abutting engagement with said outer face in the absence of an external load on said pneumatic spring compressing said resilient means.

2. A column as set forth in claim 1, wherein said resilient means includes a helical compression spring.

3. A column as set forth in claim 1, wherein said resilient means includes a stack of belleville washers.

4. A column as set forth in claim 1, wherein said resilient means includes a tube of elastomeric material.

5. A column as set forth in claim 4, wherein the internal diameter of said tube of elastomeric material is substantially larger than the outside dimension of said bar member so as to provide a substantial clearance therebetween.

6. A column as set forth in claim 1, wherein said one member of the pneumatic spring is said piston rod member, said bar member being longitudinally aligned with said piston rod member and of smaller cross section, whereby an annular end face of said piston rod member is exposed adjacent said bar member, said end face constituting said spring seat means.

7. A column as set forth in claim 1, wherein said one member of the pneumatic spring is said cylinder member.

8. A column as set forth in claim 1, wherein a longitudinally terminal part of said guide tube is formed with an orifice of said bore therein said pneumatic spring, said bar member, said spring seat means, and said yieldably resilient means being dimensioned for joint longitudinal movement through said orifice.

9. A column as set forth in claim 8, wherein said abutment member constitutes the sole means preventing said joint movement in a direction outward of said bore.

10. A column as set forth in claim 1 further comprising a rotatable thrust bearing axially interposed between said resilient means and one of said spring seat means and said axially inner face.

11. A column as set forth in claim 1, wherein said yieldably resilient means comprises a stack of belleville washers extending about said bar member and operatively interposed between said spring seat means and said axially inner face.

12. A column as set forth in claim 1, wherein said yieldably resilient means comprises a helical compression spring extending about said bar member and operatively interposed between said spring seat means and axially inner face.

13. A column as set forth in claim 1, wherein said yieldably resilient means affords additional resilience in the column even when said piston rod has reached the axially innermost position within said cylinder member.

* * * * *